US006160764A

United States Patent [19]

Powell

[11] Patent Number: 6,160,764

[45] Date of Patent: Dec. 12, 2000

[54] REPLACEABLE TROLLING MOTOR TRANSDUCER

[75] Inventor: Michael Powell, Arlington, Tex.

[73] Assignee: Molded Parts Specialist, Inc., Arlington, Tex.

[21] Appl. No.: 09/343,672

[22] Filed: Jun. 30, 1999

[51] Int. Cl.[7] ..... H04R 1/44

[52] U.S. Cl. ..... 367/173

[58] Field of Search ..... 367/173, 172

[56] References Cited

U.S. PATENT DOCUMENTS

| | | | |
|---|---|---|---|
| 4,737,940 | 4/1988 | Arringotn | 367/173 |
| 4,926,399 | 5/1990 | Hickman | 367/173 |
| 4,995,010 | 2/1991 | Knight | 367/173 |

*Primary Examiner*—Ian J. Lobo
*Attorney, Agent, or Firm*—Birch, Stewart, Kolasch & Birch, LLP

[57] ABSTRACT

An electric trolling motor for propelling a boat and comprising an electric propulsion motor having a substantially cylindrical motor housing and an electric trolling motor end cap for mounting and protecting a transducer therein, the end cap comprising a body portion having a recess integrally formed therein for receiving a transducer in the recess and a transducer removably mounted in the recess, a bore formed in the end cap creating a passageway extending from the exterior of the end cap to the interior of the recess, and a releasable air pressure seal for obturating the passageway and retaining the transducer in the recess when the passageway is obturated, and releasing the air pressure seal when the passageway is opened; also, a novel end cap for electric trolling motors.

13 Claims, 3 Drawing Sheets

REPLACEABLE TROLLING MOTOR TRANSDUCER

This invention relates to an improved trolling motor transducer. More particularly, the invention relates to a trolling motor mounter sonar transducer which can be easily replaced without disassembling the trolling motor.

BACKGROUND AND OBJECTS OF THE INVENTION

For many years, electric trolling motors have been used in conjunction with sonar depth finders, and particularly by sport fishermen, as a fishing aid. The sonar depth finders help the fisherman to find desirable fish habitat, underwater bottom features and cover such as brush piles and underwater grass. This information is extremely helpful for a fisherman to locate likely places to catch fish. The electric trolling motor is a small electric motor mounted either on the bow or stern of a fishing boat, and is used to maneuver the boat in the water, with minimal noise and disruption of the water.

The depth finders used in this manner require a transducer which transmits a sonar signal into the water and receives the returned echo, displaying the depth. In addition, the depth finder displays a signal indicative of other things between the bottom and the transducer, such as grass, brush, and occasionally fish. Often, sonar transducers have been attached to the trolling motor in order to position the transducer in the water, and allow its quick withdrawal from the water when moving the boat under power of a larger internal combustion engine. Such transducers have often been clamped to the electric motor housing, or attached to the motor mounting shaft, and connected to the sonar depth finder display head by means of a cable which would extend along the motor mounting shaft.

One problem with this arrangement, though, has been that repeated raising and lowering of the electric trolling motor on its mounting bracket would occasionally damage the transducer or the cable, rendering the sonar depth finder inoperative. Moreover, the transducer occasionally would strike an underwater object such as a stump, a rock, or the like, and damage to the transducer would result.

U.S. Pat. No. 4,737,940 provided an improved transducer mounting arrangement in which the transducer was mounted in a recess in the trolling motor housing in such a way that only the operative or discharge face of the transducer was exposed to the water, thus minimizing damage to the transducer by contacting underwater object. In addition, the cable for the transducer extended internally of the motor housing and the motor mounting shaft, thus protecting the cable itself from damage. This improvement represented a significant advance in the trolling motor and depth finder field.

However, occasionally a transducer fails from internal electrical or mechanical problems and must be replaced. In order to replace such a built in transducer, it is necessary to completely disassemble the trolling motor, remove the defective transducer and its cable, and then thread the new cable back through the trolling motor housing and shaft and re-seal the transducer in its socket in the motor housing in order to make certain that water did not enter the motor housing. This has been a very time consuming operation, which could prevent the user from fishing for several days.

The transducer itself used in the past either internally housed or externally attached to the trolling motor has been a small cylindrical puck, generally about one inch in diameter and up to an inch in height, with the actual crystal transducer being potted inside the puck. The cable is sealed as well by the potting material. Such a structure provides a high degree of protection for the transducer, but nonetheless, failures of the transducer do occur.

The present invention has as its primary object to provide a transducer for use in an electric trolling motor which overcomes the disadvantages of prior art transducers.

Another object of the invention is to provide an improved transducer which may be easily and quickly replaced without a need to disassemble the trolling motor.

Still another object of the invention is to provide an improved mounting arrangement for securely retaining a replaceable transducer in a socket in an electric trolling motor housing.

A further object of the invention is to provide a replaceable sonar transducer which may be mounted in an electric trolling motor housing while protecting the electric motor from damage by water leakage.

Yet another object of the invention is to provide a replaceable sonar transducer which is securely held in a recess in a trolling motor housing.

Still a further object of the invention is to provide an improved electric trolling motor having a replaceable sonar transducer mounted in the housing thereof in a water tight manner.

DESCRIPTION OF THE INVENTION

According to the present invention, the trolling motor is provided with a nose-cone or end cap for the motor housing which incorporates the transducer mounting. This nose-cone or end cap may also provide a mounting for a bearing which rotationally supports one end of the motor shaft. On the lower side of the nose-cone or end cap, a cylindrical recess is provided which is of a size just slightly larger than that of the transducer puck. A pair of electrical contacts are provided in the recess for receiving corresponding terminals on the transducer puck for connecting the transducer crystal to the depth finder control head.

A cylindrical transducer puck is provided, and has a flat end face which will be flush with the bottom of the nose-cone after the puck has been inserted into the recess. An O-ring surrounds the cylindrical puck to seal the puck inside the recess and keep water from entering into the motor housing when the motor is submerged for use.

Although the O-ring provides a very good seal, preventing water from entering the motor, when the puck is inserted into the recess, air in the recess becomes pressurized as the puck is forced into the recess. As a result, the compressed air would over time force the puck back out of the recess. In order to avoid this phenomenon and more securely retain the puck in the recess, a releasable air pressure seal is provided to seal and secure the transducer in the recess and provide a holding force for retaining the puck in the recess. To this end, a security valve is provided for selectively obturating an air passage leading from the exterior into the puck mounting recess. The security valve comprises a bore extending from the front exterior of the nose-cone into the transducer recess. The bore is threaded and threadedly receives an obturating plug or screw therein.

While the screw may simply be a plug, it would preferably have a tapered or needle like shape on the end and a correspondingly shaped seat formed in the internal end of the bore, for cooperating with the screw for creating a good seal when the screw is fully threaded into the recess. The screw may also have an O-ring thereon in order to provide a seal with the bore.

With this construction, if the security valve is loosened before the transducer is pushed into the recess, while the transducer puck is being inserted into the recess, air is forced out of the threaded bore until the transducer is firmly seated in its recess. At this point the air pressure on the inside of the recess is the same as the ambient air pressure on the outside of the housing. Then, the screw of the security valve is tightened in order to seal the opening. Thereafter, if one attempts to remove the transducer puck from the recess, a vacuum is created, helping to retain the puck in the recess and helping to secure the transducer puck against accidentally falling out of the nose-cone. Yet, should the transducer fail for any reason, it is a simple matter to open the security valve in order to allow the passage of air, and then remove the transducer puck from the recess and replace it with a new one.

In one embodiment, the transducer is provided with a pair of electrical contact pins extending from the inner flat surface of the puck. These pins make electrical contact with the transducer crystal which is potted in the puck, and my be inserted into corresponding sockets in the recess for making electrical contact with the circuitry of the sonar depth finder. The sockets are connected by a cable passing through the motor housing, and up the shaft to the top of the motor. At that point, the cable can be terminated by a connector mounted in the top housing of the trolling motor system, where it can be connected to a depth finder housing. Or alternatively, the cable may pass up through the mounting shaft and outwardly directly to the sonar depth finder housing.

In either case, the pins on the transducer puck must be aligned with the sockets in the recess, and to facilitate this alignment, a flat is formed on the exterior of the puck. A corresponding flat is formed on the inner wall of the recess in the nose cone, so that the flat on the puck must be aligned with the flat on the wall of the recess in order to push the puck into the recess, and once the flats are aligned, the contact pins are aligned with the sockets.

Other types of electrical contacts may be provided, but provision should be made so that misalignment of the contacts cannot result in damage by misalignment when the transducer puck is inserted into the recess.

This invention also permits the use of different frequency transducers, depending on the particular manufacturer of the sonar depth finder or the conditions of use. Since different sonar depth finders use transducers which differ in their frequency, changing sonar units may require a new transducer, and the present invention permits this change to be made quite easily.

DESCRIPTION OF THE DRAWINGS

The invention will now be described in greater detail with reference to the accompanying drawings, which show by way of non-limiting example, a preferred embodiment of this invention, and in which.

DESCRIPTION OF DETAILED EMBODIMENTS

Figure 1:
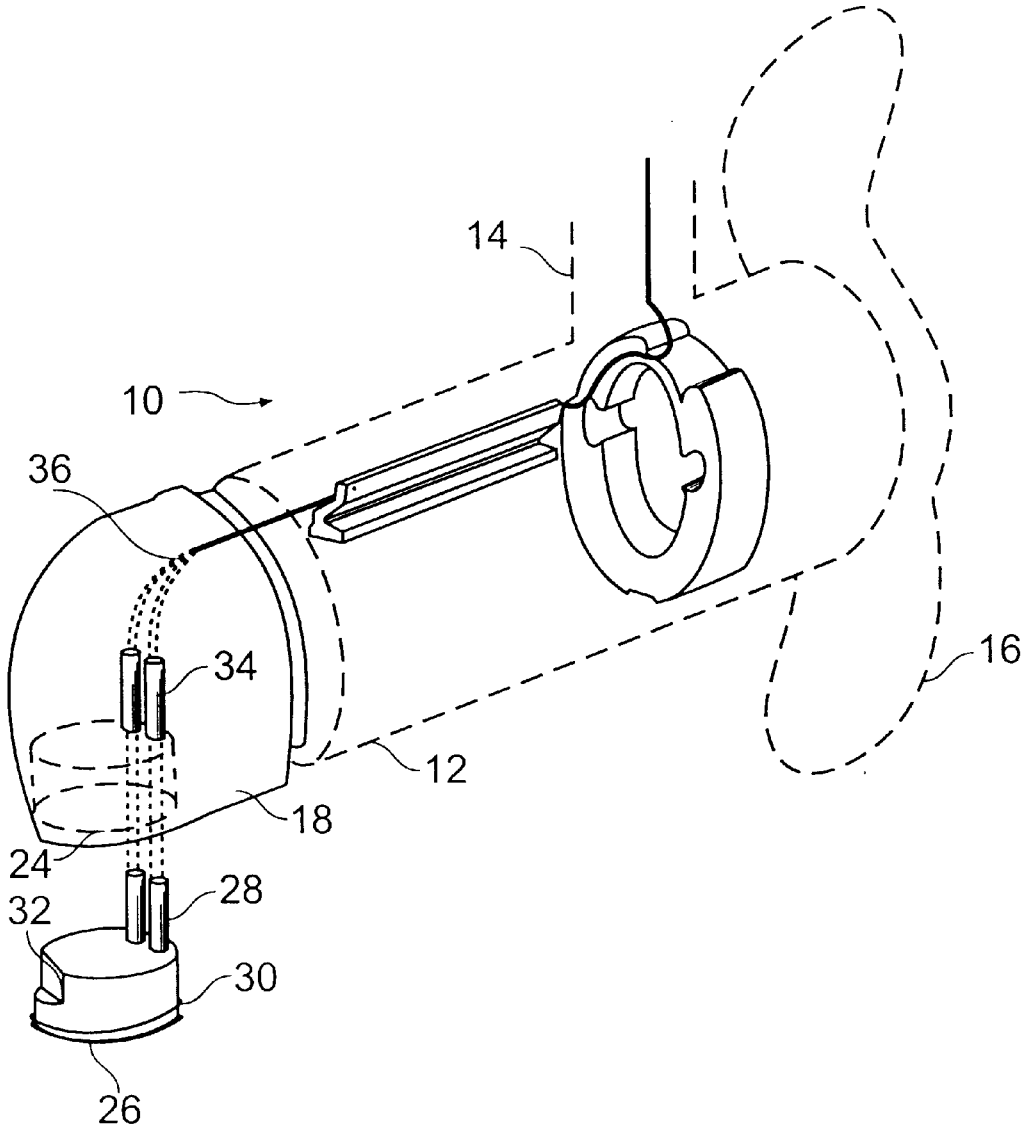
FIG. 1 is an exploded perspective view of a trolling motor housing with the transducer puck about to be installed in the nose cone.
Figure 2:
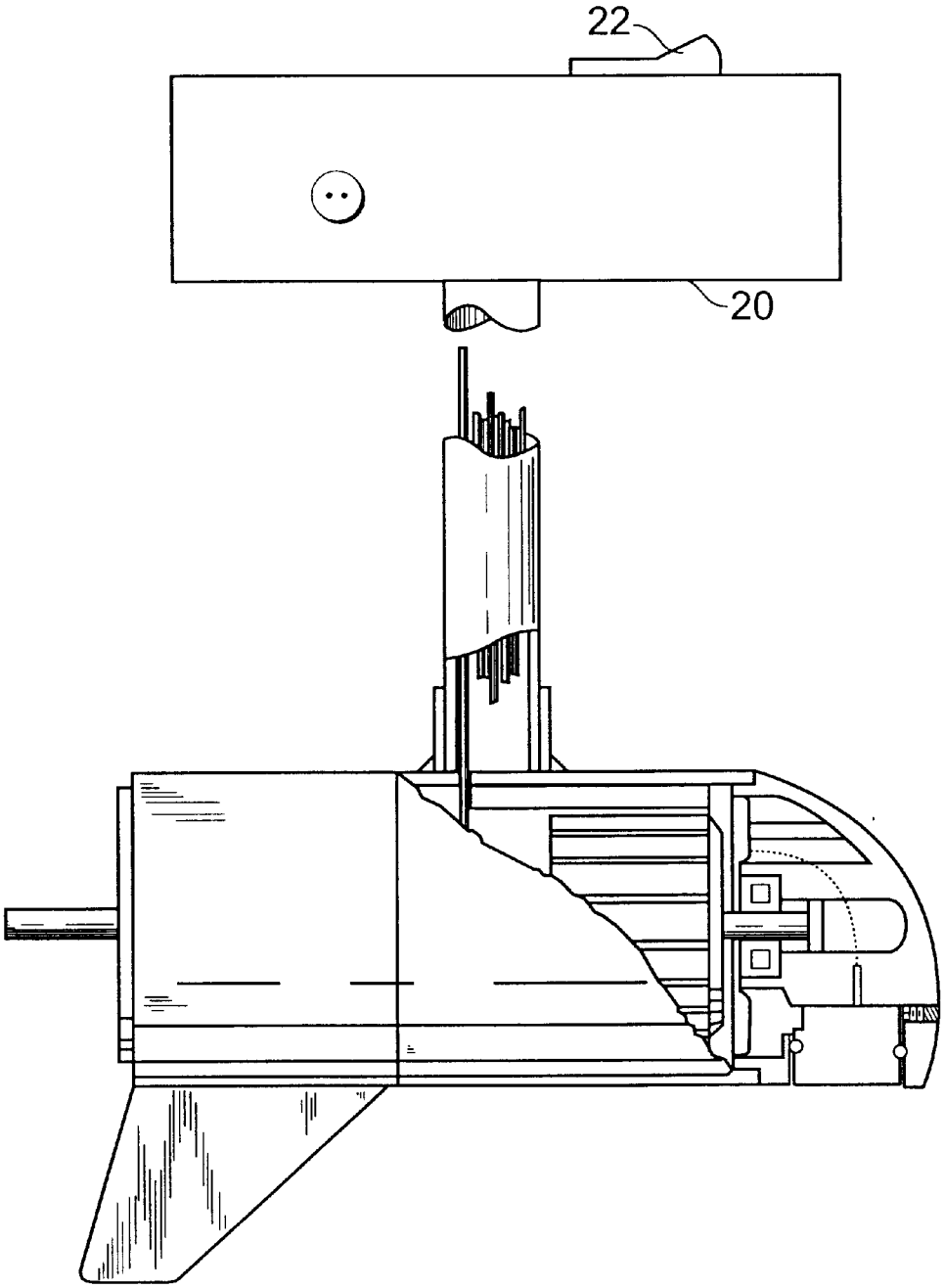
FIG. 2 is a fragmentary side view of a trolling motor housing showing the transducer puck installed in the nose cone.

As shown in FIGS. 1 and 2, a trolling motor lower unit generally designated 10 comprises a cylindrical housing 12 having a support shaft 14 which extends upwardly from the housing 12 for mounting on a boat by means of a bracket (not shown). The housing 12 contains the field coils and the armature of the electric motor and on one end of the armature shaft a propeller 16 is mounted.

At the other end of the housing, an end cap or nose cone 18 is provided, and includes a bearing for supporting the other end of the armature shaft. At the upper end of the shaft 14, a control head 20 houses one or more switches 22 which control the operation of the electric motor.

The end cap or nose cone 18 is provided with a recess 24 which receives a sonar transducer puck 26. The puck 26 contains the crystal potted in a cylindrical plastic housing, and includes two electrical contact pins 28 extending upwardly from the puck 26. The puck 26 also is provided with an O-ring 30 surrounding the puck 26. One side of the puck 26 has a "flat" 32 formed thereon. The recess 24 has a similarly shaped flat formed therein, in order that the puck 26 may only be inserted in one direction, that being with the pins 28 is alignment with corresponding contact sockets 34 in the end cap. In this manner, as the puck 26 is inserted into the recess 24, the pins 28 must enter the sockets 34, making electrical contact. If the flat 32 on the puck is not aligned with the corresponding flat on the recess, the puck cannot be inserted, and damage to the pins is avoided.

The sockets 34 have electrical wires 36 extending therefrom, along the field windings of the motor, and up through the shaft 14 to the control head. At the control head 20, the transducer wires may terminate in a socket type connection generally indicated at 40 on the control head 20. In this manner, a display head for a sonar depth finder may be mounted on the boat and connected to the transducer by means of a cable connected to the socket 40. Alternatively a display head may be integrated into the control head of the trolling motor and no external connection would be needed.

Figure 3:
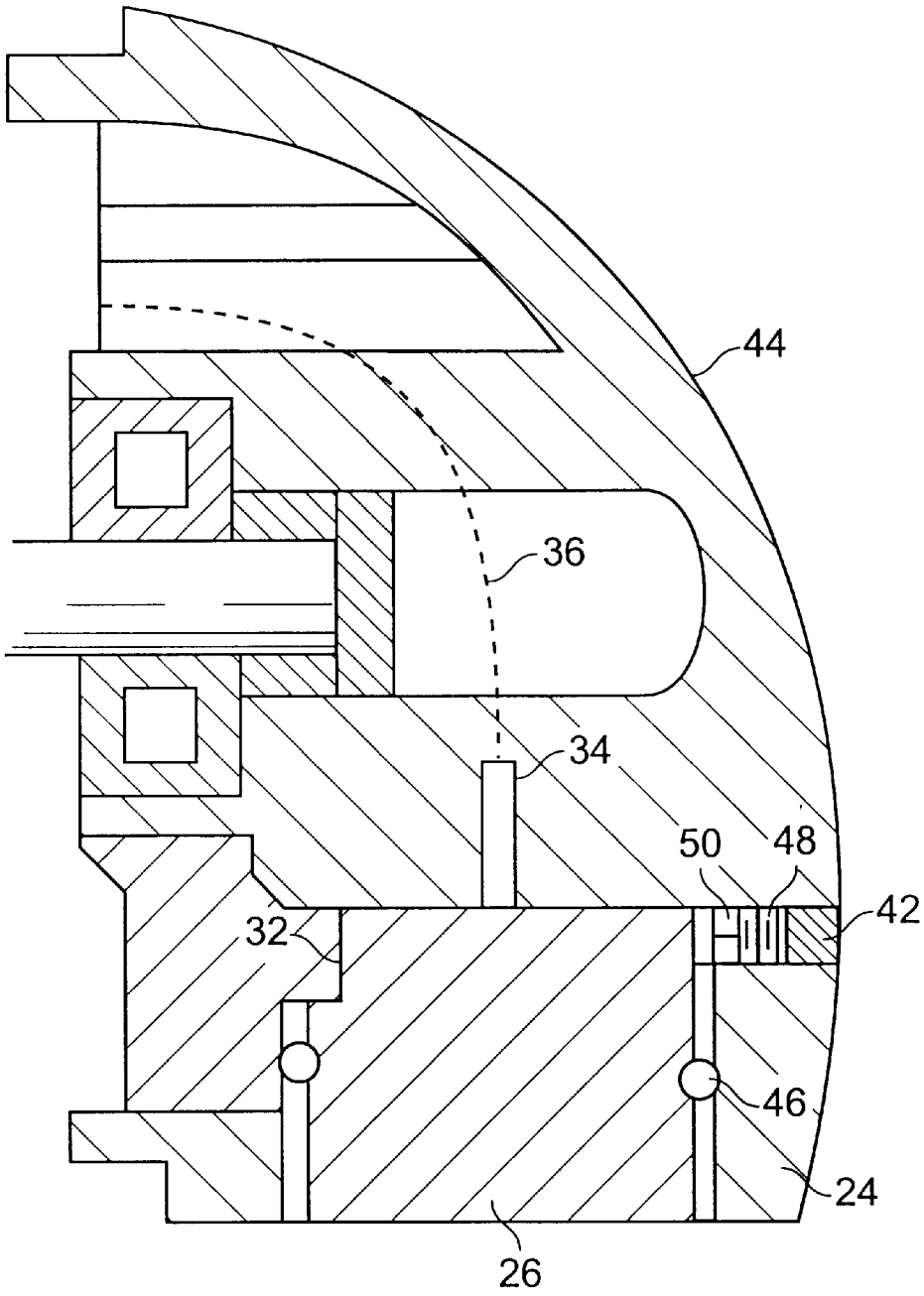
FIG. 3 is an enlarged cross-sectional view of the end cap with the transducer installed therein.

As seen in FIGS. 2 and 3, a threaded bore 42 is provided in the end cap 44 of the motor, and opens into the recess 24 in the end cap 44. The transducer puck 26 is inserted in the recess 24 in the end cap 44, and an O-ring 46 seals the transducer/recess. The threaded bore 42 has a threaded plug 48 screwed into the bore 42. The threaded plug 48 may simply seal against the a boss 50 at the end of the bore, or other variations may be provided to ensure that an air tight pressure seal is established when the plug 48 is screwed all the way into the bore 42. In some cases, an O-ring may surround the threaded plug 48 to help this seal. In another alternative, a tapered needle type of end may be formed on the plug and may engage a tapered seat formed in the bore 42. The plug may have a slot for engagement by a screw driver or a shaped opening for engagement by a similarly shaped wrench. In any case, tightening the plug 48 in the opening 42 makes an airtight seal, while unscrewing the plug 48 allows air to enter the threaded bore and the recess 24. This releasable air pressure seal thus not only prevents water leakage into the motor housing, but also helps to retain the transducer puck in the housing against accidental removal.

While this invention has been described as having certain preferred features and embodiments, it will be understood that it is capable of still further variation and modification without departing from the spirit of the invention, and this application is intended to cover any and all variations, modifications and adaptations as may fall within the spirit of the invention and the scope of the appended claims.

I claim:

1. An electric trolling motor end cap for mounting and protecting a sonar transducer therein comprising a body portion having a recess integrally formed therein for receiving a transducer therein, a threaded bore formed in said end cap and extending from the exterior of said end cap to the interior of said recess, a transducer in said recess, and a releasable air pressure seal obturating said bore for retaining said transducer in said recess when said bore is obturated, and releasing the air pressure seal when said bore is opened.

2. An electric trolling motor end cap as in claim 1 and wherein said transducer includes an O-ring engaging the wall of said recess and said transducer for sealing said transducer in said recess.

3. An electric trolling motor end cap as in claim 2 and wherein said air pressure seal comprises a valve in said bore.

4. An electric trolling motor end cap as in claim 2 and wherein said air pressure seal comprises a threaded plug in said bore.

5. An electric trolling motor end cap as in claim 2 and wherein said air pressure seal comprises a threaded member having an O-ring engaging said member and the wall of said bore.

6. An electric trolling motor end cap as in claim 2 and wherein said bore and has a tapered inner end, and said air pressure seal comprises a threaded member having a correspondingly tapered outer surface for coacting with said tapered inner end and obturating said bore.

7. An electric trolling motor end cap as in claim 2 and wherein said transducer includes a pair of electrical contact pins extending therefrom and engaging a pair of electrical sockets in said housing for establishing an electrical connection with said transducer.

8. An electric trolling motor end cap as in claim 7 and wherein said recess includes a flat portion formed in the wall thereof, and said transducer includes a flat formed on the exterior wall thereof, whereby said flat coacts with said flat portion such that said transducer may only be inserted in said recess when said flat is aligned with said flat portion.

9. An electric trolling motor for propelling a boat and comprising an electric propulsion motor having a substantially cylindrical motor housing and an electric trolling motor end cap for mounting and protecting a transducer therein, said end cap comprising a body portion having a recess integrally formed therein for receiving a transducer in said recess, a transducer removably mounted in said recess, a threaded bore formed in said end cap and extending from the exterior of said end cap to the interior of said recess, and a releasable air pressure seal for obturating said bore and retaining said transducer in said recess when said bore is obturated, and releasing the air pressure seal when said bore is opened.

10. An electric trolling motor as in claim 9 and wherein said releasable air pressure seal comprises a valve member threaded into said bore.

11. An electric trolling motor as in claim 10 and wherein said releasable air pressure seal prevents the ingress of air into said recess and allows creation of a holding force on said transducer resisting removal thereof until said valve member is opened.

12. An electric trolling motor as in claim 11 and wherein said transducer includes electrical contact means projecting therefrom, and means for assuring alignment of said contact means in said recess.

13. An electric trolling motor as in claim 12 and wherein said means for assuring alignment of said contact means comprises a flat on one side of said transducer and a corresponding flat portion on one side of said recess.

* * * * *